United States Patent [19]

May

[11] Patent Number: 4,570,522

[45] Date of Patent: Feb. 18, 1986

[54] ELECTRO-ACOUSTICALLY AMPLIFIED DRUM AND MOUNTING BRACKET

[76] Inventor: Randall L. May, 8312 Seaport Dr., Huntington Beach, Calif. 92646

[21] Appl. No.: 563,150

[22] Filed: Dec. 19, 1983

[51] Int. Cl.[4] ..... G10H 3/00

[52] U.S. Cl. ..... 84/1.14; 84/421; 84/DIG. 12

[58] Field of Search ..... 84/1.14, 411 R, DIG. 12, 84/421, 1.04

[56] References Cited

U.S. PATENT DOCUMENTS

| | | | |
|---|---|---|---|
| 4,201,107 | 5/1980 | Barber, Jr. et al. | 84/1.14 |
| 4,226,156 | 10/1980 | Hyakutake | 84/1.14 |
| 4,242,937 | 1/1981 | Pozar | 84/1.15 |

*Primary Examiner*—Forester W. Isen

*Attorney, Agent, or Firm*—Neal J. Mosely

[57] ABSTRACT

An electro-acoustically amplified drum assembly consists of a hollow drum shell with a drum head closing one or both end thereof. An acoustical microphone is positioned in the drum shell spaced from and free from any connection to the drum head and has leads for connection to an external amplifier and speaker. An adjustable mount is secured on and extending through the wall of the drum shell for supporting the microphone. The adjustable mount includes a mechanism for adjusting the position of the microphone for minimizing microphone interference and optimizing proximity effect and sound quality.

26 Claims, 8 Drawing Figures fig. 4
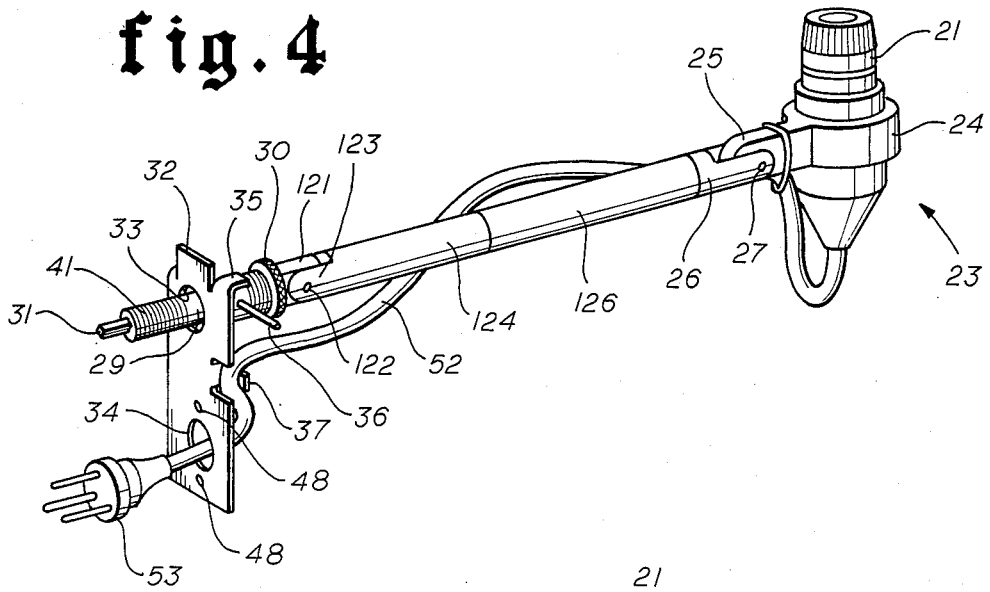
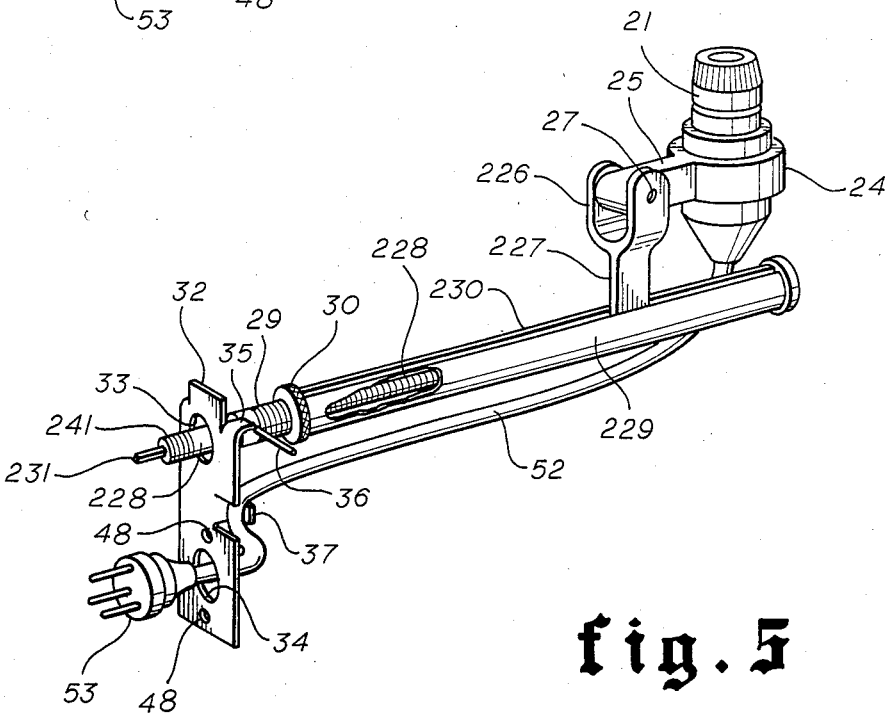
fig. 5 fig. 6
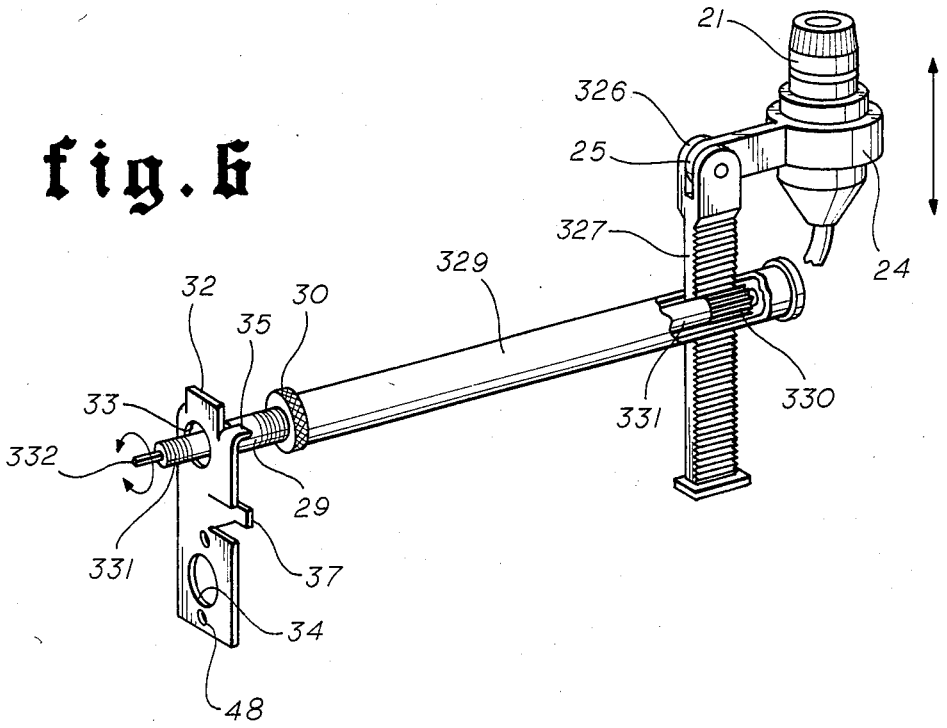
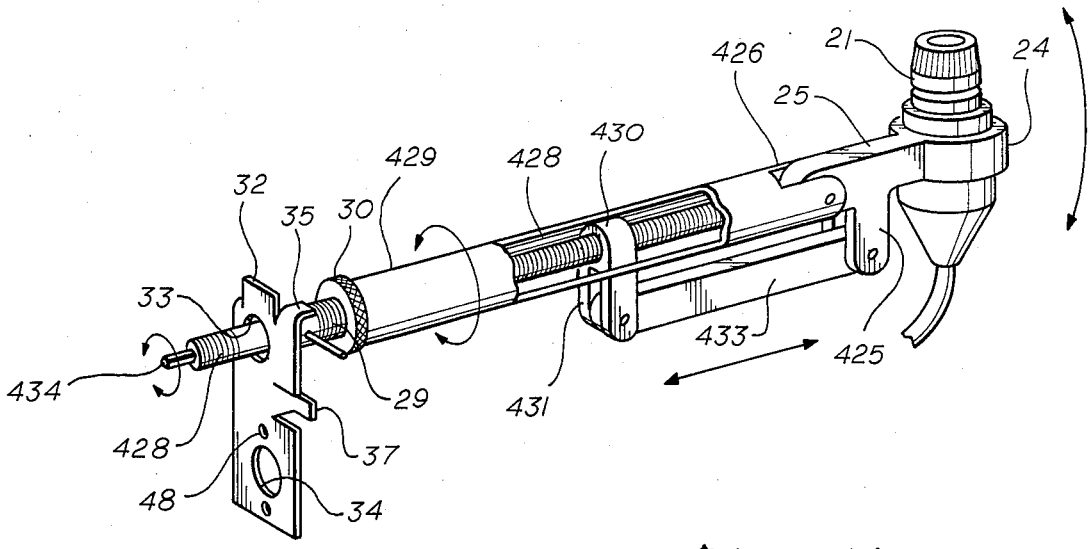
fig. 7

ELECTRO-ACOUSTICALLY AMPLIFIED DRUM AND MOUNTING BRACKET

BACKGROUND OF THE INVENTION

1. Field of the Invention

This invention relates to a new and improved electro-acoustically amplified drum assembly, and a microphone assembly and mounting bracket therefor.

2. Brief Description of the Prior Art

Conventional drums consist of a hollow drum shell having one or more drum heads held in place by head hoops. Conventional drums are usually not tunable except in a very narrow range by adjustment of the head hoop. Likewise, conventional drums have not been electrically amplified in a satisfactory manner.

The placing of an electrical microphone adjacent to the drum head of a conventional drum has not proved satisfactory since only the vibrating sound from the drum head is amplified and there is very little amplification of the resonant components of the sound. The placing of an electric microphone inside a conventional drum is resulted in the amplification of a mixture of vibratory sounds which amplification which has not been musically acceptable.

Green U.S. Pat. No. 3,509,264 discloses on attempt to amplify percussion instruments including drums. In this patent, an electric pickup is cemented to the skin of drum head and vibrates adjacent to a magnet which constitutes the remainder of the pickup and is secured to a fixed part of the drum shell. In arrangement of this type may produce an amplification of vibration of the drum skin but does not produce an amplification acoustically of the sounds originating from the drum skin and by resonance from the drum shell.

Dominguez et. al. U.S. Pat. No. 3,553,339 discloses a drum-like instrument in which the diaphragm skin carries one part of an electrical pick up and another part of the electrical pick up is supported on the shell. This device provides for amplification of vibrations of the diaphragm or skin of the drum head but does not provide for amplification of acoustical sound mixture produced by the drum.

Ebihara et. al. U.S. Pat. No. 3,596,959 discloses a drum in which the diaphragm or skin of the drum head carries a magnet which moves relative to a sensing element. This arrangement provides only for amplification of the vibrations from the drum head and not of the mixture of acoustical sounds produced by the drum.

Parsons U.S. Pat. No. 3,008,367 discloses an electronic snare drum. This device consist of strings and strikers but has no drum head.

Rizutti U.S. Pat. No. 3,192,304 discloses electronic amplification of a banjo. The amplification is detected externally but not by an acoustical microphone.

Kaminsky U.S. Pat. No. 3,549,775 discloses an amplifier arrangement for drums in which a speaker is connected to the side wall of the drum shell.

Glenn et. al. U.S. Pat. No. 3,551,580 discloses an electrical amplification of miniature drum heads.

May U.S. Pat. No. 4,168,646 discloses the positioning of a fixed microphone inside a drum shell in which the drum head is spaced away from the shell or other openings are provided to allow the drum to "breath". This patent represents an earlier development by the applicant which was successful in its purpose but did not allow for the amplification of drums not designed in this manner.

SUMMARY OF THE INVENTION

It is therefore an object of the present invention to provide to provide a new and improved drum or drum assembly having electro-acoustical amplification of the vibrations produced by the drum head and the resonant components produced by the drum shell.

Another object of this invention is to provide an improved tunable drum assembly including means for electro-acoustical amplification.

Another object of the invention is to provide an electro-acoustical amplification of a drum by means of a microphone mounted within the drum shell on an adjustable mount which permits movement of the microphone for tuning.

Another object of this invention is to provide an improved mounting bracket for use with drum shells which provides for adjustment of the position and orientation of a microphone within a drum shell.

Another object of this invention is to provide an improved microphone assembly for a drum shell including a bracket mountable on the shell which provides for adjustment of position and orientation of the microphone.

Other objects of the invention will become apparent from time to time throughout the specification and claims as hereinafter related.

The above noted objects and other objects of the invention are accomplished by an electro-acoustically amplified drum assembly consists of a hollow drum shell with a drum head closing one or both end thereof. An acoustical microphone is positioned in the drum shell spaced from and free from any connection to the drum head and has leads for connection to an external amplifier and speaker. An adjustable mount is secured on and extending through the wall of the drum shell for supporting the microphone. The adjustable mount includes a mechanism for adjusting the position of the microphone for minimizing microphone interference and optimizing proximity effect and sound quality.

BRIEF DESCRIPTION OF THE DRAWINGS

FIG. 4 is an isometric view of another embodiment of the drum assembly and mounting bracket for the drum assembly of FIG. 1.

FIG. 5 is an isometric view of another embodiment of the drum assembly and mounting bracket for the drum assembly of FIG. 1, illustrating adjustment of the microphone radially of the drum.

FIG. 6 is an isometric view of another embodiment of the drum assembly and mounting bracket for the drum assembly of FIG. 1, illustrating adjustment of the microphone longitudinally of the drum.

FIG. 7 is an isometric view of another embodiment of the drum assembly and mounting bracket for the drum assembly of FIG. 1, illustrating angular adjustment of the microphone in the drum.

DESCRIPTION OF THE PREFERRED EMBODIMENT

Figure 1:
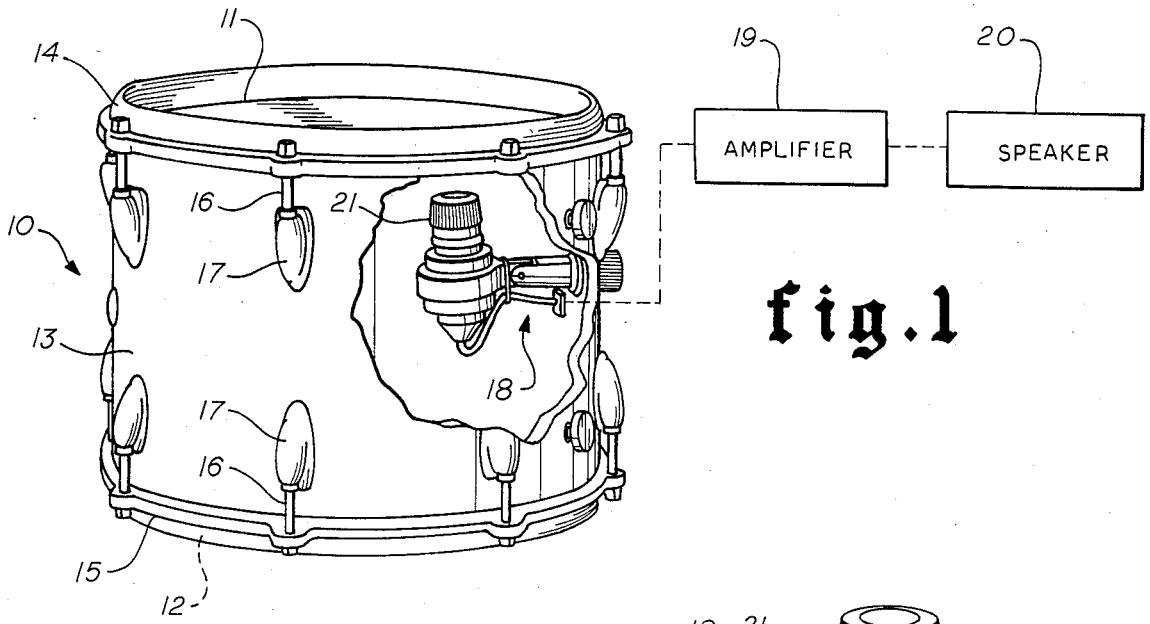
FIG. 1 is an isometric view of a drum assembly provided with a microphone and schematically connected to an amplifier and speaker.

Referring to the drawings by numerals of reference, and more particularly to FIG. 1, there is shown a drum assembly 10 which has provided for electro-acoustical amplification. In FIG. 1, the drum assembly 10 consist of upper and lower drum heads 11 and 12 which are supported on drum shell 13. Drum heads 11 and 12 are secured by tensioning hoops 14 and 15. Drum heads 11 and 12 are secured on the drum shell by conventional adjusting screws 16 which secure the tensioning hoops 14 and 15 to bosses 17 on drum shell 13. Adjustment of the bolts or screws 16 very the tension in the drum skin or diaphragm 11 and 12 to tune the output of the drum heads.

A microphone assembly 18 is provided inside the drum shell 13 and is connected to an external amplifier 19 and speaker 20. The connection to the amplifier 19 and speaker is by means of a conventional jack, described below, and connector wire. Microphone assembly 18 includes a microphone 21 which is movable inside the drum shell by means of an external adjusted mechanism, described below, to tune the sound output from the drum to the amplifier 19 and speaker 20. Details of construction of microphone assembly 18 and microphone 21, as well as the supporting and adjusting mechanism therefor as shown further in FIGS. 2 and 3 and described below.

Figure 2:
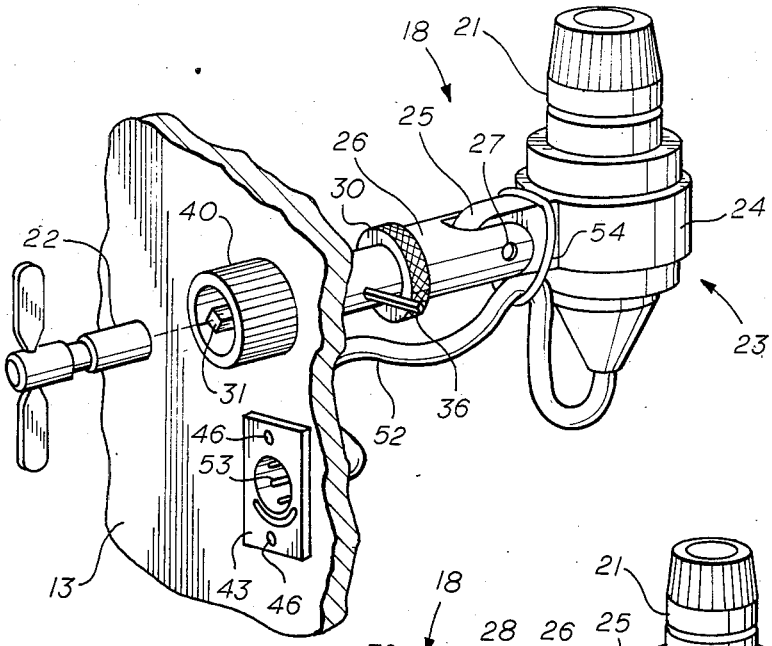
FIG. 2 is an isometric detail view of a portion of the drum shell and microphone shown in FIG. 1.
Figure 3:
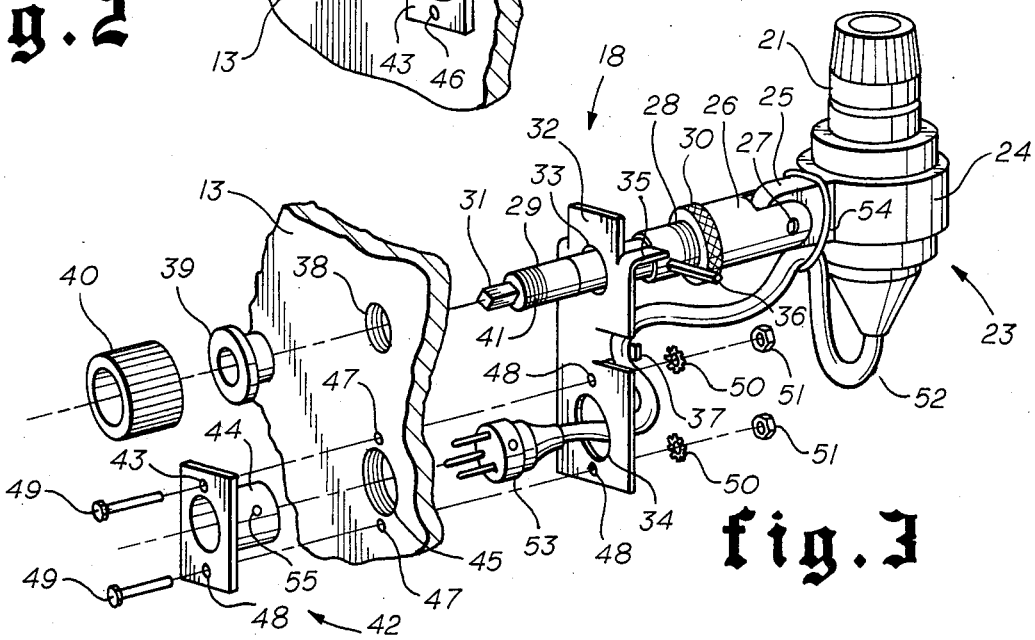
FIG. 3 is an exploded view showing the components of the microphone assembly shown in FIG. 2, illustrating the assembly thereof.

In FIG. 3, the microphone assembly 18 is shown in exploded relation to drum shell 13 to provide the clear view of the component parts thereof. In FIG. 2, the microphone assembly 18 is shown installed on drum shell 13 with a drum key 22 in exploded relation thereto for.

Referring to FIG. 3, drum microphone assembly 18 consist of microphone 21 supported in shock mount 23. Shock mount 23 a hollow, annular supporting portion 24 with a tongue abutment 25 extending laterally therefrom. Tongue 25 is supported in cleaves on pivot bolt 27 which provides for pivotal or elliptical movement of the shock mount 23 and microphone 21.

Cleaves 26 is internally threaded (not shown) and receives the enlarged threaded end portion 28 of mike rotation shaft 29. A lock nut 30 secures mike rotation shaft tightly on cleaves 26 after being screwed in place. The outer most end of mike rotation shaft 29 comprises a male adjustment portion 31 of square cross section which fits a like recess in drum key 22.

A stop plate 32 is secured on drum shell 13 and has an upper aperture 33, through which mike rotation shaft 29 extends and the lower aperture 34 which receives a mounting bracket for a microphone jack. Stop plate 32 has an inwardly extending projection providing a stop foot 35 which cooperates with role pin 36 extending from the enlarged end portion 28 of mike rotation shaft 29. Stop plate 32 is also slotted to provide a retainer 37 for the wires leading from microphone 21 to the external jack.

A hole 38 is provided in drum shell 13 in which there is positioned a tubular nylon brushing 39. Mike rotation shaft 29 extends through bushing 39 and is retained in position by an external locking knob 40 which is threadedly secured on the threaded end portion 41 of shaft 29.

A jack housing 42 consist of an external plate 43 with a tubular extension 44 extending through aperture 45 and drum shell 13. When jack housing 42 is positioned in place, holes 46 are aligned with holes 47 in drum shell 13 and holes 48 in stop plate 32. Set screws 49 are positioned through the aligned holes 46, 47, and 48 and have star washers 50 positioned thereon which assist in securing nuts 51 against coming lose. A lead or wire 52 extends from microphone 21 to a three-ten jack 53. Lead wire 52 is secured adjacent to microphone 21 by wire tie 54 and is secured adjacent to stop plate 32 by retainer 37. Jack 53 is positioned in the tubular extension 44 of jack mount or housing 42 and is secured therein by a set screw 55.

Before describing the assembly and operation of this apparatus further, a short description will be given of the problem which are encountered in amplification of sound coming from different directions to a microphone.

FACTORS IN MICROPHONE DESIGN AND PLACEMENT

Three of the major factors involved in the design and placement of microphones are polar response of a microphone, microphone interference, and proximity effect. A microphone polar response is an indication of its sensitivity to sounds originating at any point along the circumference of a circle drawn around the microphone. Microphone interference, which is also called acoustic phase cancellation, results from misplacement of a microphone so that sounds are received at different times. Proximity effect is the variation in frequency response caused by a variation in working distances from the microphone.

The problem of polar response of a microphone is mostly one which concerns a cardioid or uni-directional microphone. Microphone polar patterns may be divided into three main categories, viz. Uni-directional (cardioid), bi-directional and omni-directional.

In measuring polar response of microphones, the polar response curve is usually drawn on a piece of circular graph paper with approximately five progressively larger circumferences. Each circumference usually indicates a difference of sensitivity of five decibels from the next adjacent circumference. The radial lines on such a graph indicates the direction from the microphone. If a graph is examined showing a curve for a cardioid or uni-directional microphone it is noted that the response curve touches the outer circumference from the point labeled 0° to a point just before the 60° mark to either side. From thereon the curve slopes inward until at the 180° point it touches one of the innermost circumferences on the other side of the 180° point, the curve is a mirror image of the section just described.

If you consider the example of a constant level point source of sound located at the 0° point on the outer circumference, as the sound source moves along the circumference toward the sixty degree mark no change in sound level occurs at the microphone. As the sound source moves beyond the 60° point, it would have to move progressively closer to the microphone in order for the sound level arriving at the output of the microphone to remain the same. If the sound source remains at the same distance at the 180° point that it was at 0° the microphone would attenuate the sound by 20 decibels (in this particular example). In plotting the polar response of a microphone, the sound source is usually in a fixed location and the microphone is rotated at a fixed distance. This can be carried out for any type of microphone although the graph produced is different for uni-directional microphones, bi-directional microphones and omni-directional microphones.

The problem of microphone interference can be seen by examining the problem of the positioning of the sound source between two separate microphones or the positioning of a single microphone between various sound sources. If two microphones are placed in spaced relation, a sound source must be positioned exactly equidistant between them to produce an accurate reproduction of the sound. If the sound source is positioned exactly in a central location and not changed in direction it will not be distorted by separate microphones. However, if the sound source is moved or changed in orientation with respect to the microphones an acoustic phase cancellation takes place which results in distortion of the sound reproduced by the microphones. A similar effect takes place and a single microphone is varied in position relative to separate sources of sound.

If two microphones must be used to produce a wide angle of acceptance to cover a moving sound source, it is preferred to have the microphones relatively close together and point it at an angle to provide an angle of acceptance of about 90°–180°. As an example of the problem that it had encountered, consider the situation of positioning a number of microphones in relation to enlarge orchestras. If one musician is working about two feet from his microphone, the next adjacent microphone should be at least 6 feet away. This three to one racial of spacing was established after a long series of test and is reported in the literature dealing with microphone design and application.

The variation in frequency response caused by a variation in working distance from the microphone is known as proximity effect. This variation occurs in the low frequencies at distances of about 2 feet or less. The proximity effect characteristics of a single diaphragm microphone may be but to good use if the microphone is used correctly. This effect may add depth and fullness to a thin sound source. The distance should be closely maintained, however, once an effective working range is found, so that the boosted low end response remains constant.

The electro-acoustic amplified drum assembly shown in FIGS. 1–3 is mounted easily inside the drum shell and can be plugged into live or studio boards. This equipment mikes the internal acoustics of the drum and amplifies in which it is mounted. This eliminates microphone leakage phase cancellation. The microphone can be rotated 180° which allows each drum to be individually equalized to balance tone and volume and to isolate a wide range of internal frequencies.

ASSEMBLY AND OPERATION

To assemble the apparatus on an existing drum, the drum set is first set up as under normal playing conditions. Next, all batter heads and hoops are removed. One then determines the location on each drum shell for placement of the electro-acoustical amplification apparatus. The acoustic and electro-acoustic sound properties are not affected by the radial location of the miking system for small size drums. One must keep in mind, however, the accessability of external cables and jacks or snakes when determining location.

A template is first taped on the selected location of the drum shell after measuring the distance between the lugs so that the center line on the template is centered between the lugs and perpendicular to the edge of the drum. For small templates, as in the case of a five inch snare drum, the template mounts horizontally. Each drum to be miked is removed from its stand and secured on a clean padded work surface to prevent the drum from moving when punching and drilling.

A center punch is used to dimple the centers of the two large holes and the two small holes marked on the template. With the shell held firmly in place, the two larger holes and the smaller screw holes are drilled perpendicular to the shell. In the case of metal shells, the holes should be drilled by a drill press. It is recommended that a drum repair or machine shop drill the holes in metal shells. Masking tape applied to the back side of the drilling area on wood drums prevents splintering if excessive pressure is not applied when drilling. The template is discarded after the drilling operation is complete.

Next, the microphone assembly is prepared for installation. The microphone assembly is normally supplied with the various parts loosely assembled. First, external locking knob 40 is unscrewed from microphone rotation shaft 29 and the nylon bushing 39 is removed therefrom. Stop plate 32 is left in place. Nylon bushing 39 is inserted into hole 38, usually ½ inch in diameter, from outside the shell.

If the shell is especially thin, shorter bushings may be used and O-ring spacers as well, to fill the void between the shell an the end of the bushing. Shells which are substantially less than the ⅛ inch thickness may require additional flat washers. From inside the shell, microphone rotation shaft 29 is inserted into the hole 38 and through bushing 39. The external locking knob 40 is screwed loosely onto the threaded end portion 41 of shaft 29. It should be noted that roll pin 36 must be positioned under stop foot 35 as indicated in FIG. 3.

Next, the pin jack 53 is pushed through stop plate 32 so that the jack hangs outside the shell. Jack housing 42 is then slid on jack 53 and set screw 55 is tightened to secure the parts together. The assembled jack housing and jack are then inserted into the larger hole 45 and attached to drum shell 13 by machine screws 49. Machine screws 49 extend through the aligned holes 46, 47, and 48. Star washers 50 are positioned on the inner end portions of machine screws 49. Nuts 51 are then screwed down tight to secure plate 32 and jack housing 42 together. Next, the microphone rotation shaft 29 is held stationary with drum key 22 and locking knob 40 is turned clockwise to tighten and secure the microphone assembly.

At this point, the microphone assembly 18 is securely installed in drum shell 13. Shock mount 24 is adjusted in supporting clevis 26 to the desired orientation with respect to the drum head. Next, the drum heads are replaced and the tensioning rings tightened to the degree desired for satisfactory sound. The jack 53 is then plugged into amplifier 19 and the sound output noted from speaker 20. Drum key 22 is inserted over square end 31 of shaft 29 to rotate the shaft and the microphone mount 24 and microphone 21 to the amount necessary to produce the desired pitch and tone.

This electro-acoustical system is effective to reproduce accurately a wide range of frequencies. Consequently, will perform only as well as the drums are tuned. It is usually necessary on determining the desired pitch of each drum that each head be accurately tuned to itself. If necessary, drum heads may be replaced. If the drum is normally dampened to shorten the fundamental tone, it will still be necessary to use damping procedures as the amplification system has no effect on the length of the fundamental. This amplification system is effective to isolate a wide range of frequencies with its cardioid pick-up pattern. Coupled with the radial rotation by means of microphone rotation shaft 29, it is possible to isolate the frequency response to best reproduce the desired tonality of each drum.

The system designed allows each drum to be individually equalized (boost and/or cut off high and low frequencies). Acoustic equalization is achieved by rotating microphone 21 and also taking advantage of proximity effect, i.e. a variation in frequency response caused by variation in working distance from the microphone. To rotate microphone 21 radially external locking nut 40 is loosened and drum key 22 is used to turn the microphone rotation shaft 29.

After the desired position is located, the shaft is held steady with drum key 22 and external locking knob 40 is tightened to secure the assembly in place. The equipment has been designed to work primarily with cardioid (unidirectional) microphones. The adjustable features, however, permit its use with bi-directional and omnidirectional microphones.

DESCRIPTION OF ADDITIONAL EMBODIMENTS

In FIGS. 4–7, there are illustrated several additional embodiments of the apparatus which provide for installation in larger drum assemblies such as base drums and the like, and which provide for additional adjustments in positions of the microphone from outside the drum shell.

AMPLIFICATION OF BASE DRUMS

In FIG. 4, there is shown an embodiment of the apparatus designed for amplifying base drums or other large diameter drums. In this embodiment, the microphone mount and the supporting mechanism are the same as in FIGS. 1–3, and the parts are given the same reference numbers. The main difference between this embodiment and the embodiment of FIGS. 1–3 is that an extension is provided for supporting the microphone at a greater distance from the drum shell and therefor more centrally of a larger drum. In addition, the extension is provided with a pivotal connection which allows for a manual vertical adjustment of the microphone.

In this embodiment, microphone 21 is supported in shock mount 24 and the tongue portion 25 is supported in clevis 26, as in FIGS. 2 and 3. Clevis 26 is supported on an intermediate supporting rod 126 which is supported on rod 124 having an end yoke 123 pivotally connected as at 122 to supporting rod 121. Microphone rotating shaft 29 is threadedly secured in supporting rod 121 and locked in place with lock nut 30.

This embodiment of the microphone assembly is installed in enlarged drum, such as a base drum, following the same assembly procedure described for the apparatus of FIGS. 1–3. The pivotal connections at the opposite ends of extension rods 124 and 126 allow for vertical adjustment of microphone 121 in relation to the drum head. The pivotal connection at clevis 26 allows for pivotal or elliptical adjustment of the position of the microphone. The rotation of the microphone assembly in the drum is carried out in the same manner as described for the microphone assembly of FIGS. 1–3 using the drum key 22.

MICROPHONE ASSEMBLY WITH REMOTE RADIAL ADJUSTMENT

In FIG. 5, there is shown a microphone assembly which provides for radial adjustment of microphone 21. The rotary adjustment of the microphone utilizes the same mechanism as described in the other embodiments above. In this embodiment of the invention similar parts will be given, similar reference and numerals to avoid duplication.

In this embodiment, microphone 21 is supported in shock mount 24 with tongue extension 25 extending into clevis member 226. Clevis 226 has a downwardly extending stem portion 227 with a threaded opening (not shown) at the lower end receiving a threaded shaft 228 for longitudinal or radial adjustment. Shaft 228 and clevis 227 are supported in tubular shell 229 having a longitudinally extending slot 230. Rotation of shaft 228 moves clevis 226 longitudinally of tubular shell 229 to determine precisely its position radially of the drum shell. Elliptical movement of the microphone 21 is accomplished by pivoting shock mount 24 as described above. Radial movement is accomplished by the gear shaft 228 as just described. Housing 229 is supported on microphone rotation shaft 29 secured in position by lock nut 30.

Radial adjusting shaft 228 extends out through microphone rotating shaft 29 to the exterior of the apparatus and has a threaded end portion 241 which receives locking knob 40. Shaft 228 also has square end portion 231 which permits rotation by drum key 22. When this microphone assembly is assembled on a drum shell the rotation of the square end portion 231 by drum key 22 is effective to adjust both the longitudinal or radial position of microphone 21 in the drum and also to rotate the microphone as described for the other embodiments.

In this embodiment when locking knob 40 is loosened the rotation by the drum key causes the microphone to be turned as in the previous embodiments. When the locking knob is tightened, drum key 22 can rotate square end portion 231 to turn threaded shaft 228 to adjust the position of microphone 21 radially inside the drum shell. This embodiment allows for radial and rotational adjustment of a microphone from outside the drum shell. Elliptical adjustment is taken care of manually at the time of installation or at any other time that a drum head is removed.

REMOTE VERTICAL ADJUSTMENT OF MICROPHONE

In FIG. 6, there is shown a further embodiment of the invention which provides for remote vertical adjustment of the microphone in the drum shell. In this embodiment, the components which are common to the other embodiments of the microphone assembly are given the same reference numerals.

In FIG. 6, microphone 21 is supported in shock mount 24 which has its supporting tongue portion 25 supported in the clevis 26. Clevis 326 has an extension in the form of a rack 327 which extends through a hollow supporting tube 329. A pinion 330 is positioned in tube 329 and cooperates with rack 327 for vertical adjustment of the microphone assembly. Pinion 330 is carried on rod 331 which extends outside the drum shell through microphone rotation shaft 29. Microphone rotation shaft 29 is threadedly supported in tube 329 and secured in place by locking nut 30. Shaft 31 has a square end portion 332 for adjustment by drum key 22.

When this microphone assembly is installed on a drum shell the operation of the square end 332 by drum key 22 is capable of adjusting the position of the microphone 21 vertically and also of rotating the microphone supporting shaft. When the external locking knob 40 is loosened, the rotation of square end portion 332 is operable to rotate the microphone supporting shaft as in the other embodiments. When the external locking knob 40 is tightened, the rotation of square end portion 332 is operable to rotate the shaft 331 inside tube 329 to cause pinion 330 to move rack 327 and adjust the position of microphone mount 24 and microphone 21 vertically in relation to the drum head.

REMOTE ELLIPTICAL ADJUSTMENT OF MICROPHONE

In FIG. 7, is shown a further embodiment of the invention in which the microphone may be adjusted for elliptical movement by the remote mechanism turned by the drum key. This embodiment is very similar to the ones shown in FIGS. 5 and 6 in that a operating shaft is rotated inside a supporting shaft to provide a remote adjustment.

In this embodiment, microphone 21 is supported on shock mount 24. The tongue portion 25 of shock mount 24 is supported in the end of a yoke or clevis 426 which is integral with a supporting tube 429. Tongue portion 25 of shock mount 24 has an extension 425 in the form of a clevis or yoke integral therewith. Supporting tube 429 is slotted along the bottom edge, not shown, to provide for movement of an operating linkage. Threaded shaft 428 is rotatable inside supporting tube 429.

Threaded shaft 428 provides a worm gear connection inside a threaded block 430 which is moved backward and forward inside tube 429 on rotation of shaft 428. Block 430 has a yoke portion 431 connected by linkage 433 to yoke 425 on shock mount 424. Movement of block 430 longitudinally of supporting tube 429 causes linkage 433 to pivot shock mount 24 to provide elliptical movement of microphone 21. Supporting tube 429 is supported on microphone rotating shaft 29 which is locked in place by lock nut 30. Shaft 29 has rotating shaft 428 extending therethrough. Shaft 428 has a square end portion 434 which is operated by drum key 22.

When this apparatus is assembled in the drum shell the rotation of square end portion 434 by drum key 22 is operable either to rotate the microphone supporting shaft 29 or to turn threaded shaft 428 to adjust the linkages to provide remote elliptical adjustment of shock mount 24 and microphone 21. When external locking knob 40 is tightened, rotation of square end portion 434 by drum key 22 is operable to turn threaded shaft 428 to provide elliptical adjustment of shock mount 24 and microphone 21 as previously described. When locking knob 40 is loosened, rotation of square portion 434 by drum key 22 is operable to turn the microphone supporting shaft 29 to rotate shock mounts 24 and microphone 21 about the access of supporting tube 429.

REMOTE UNIVERSAL ADJUSTMENT OF MICROPHONE ASSEMBLY

Figure 8:
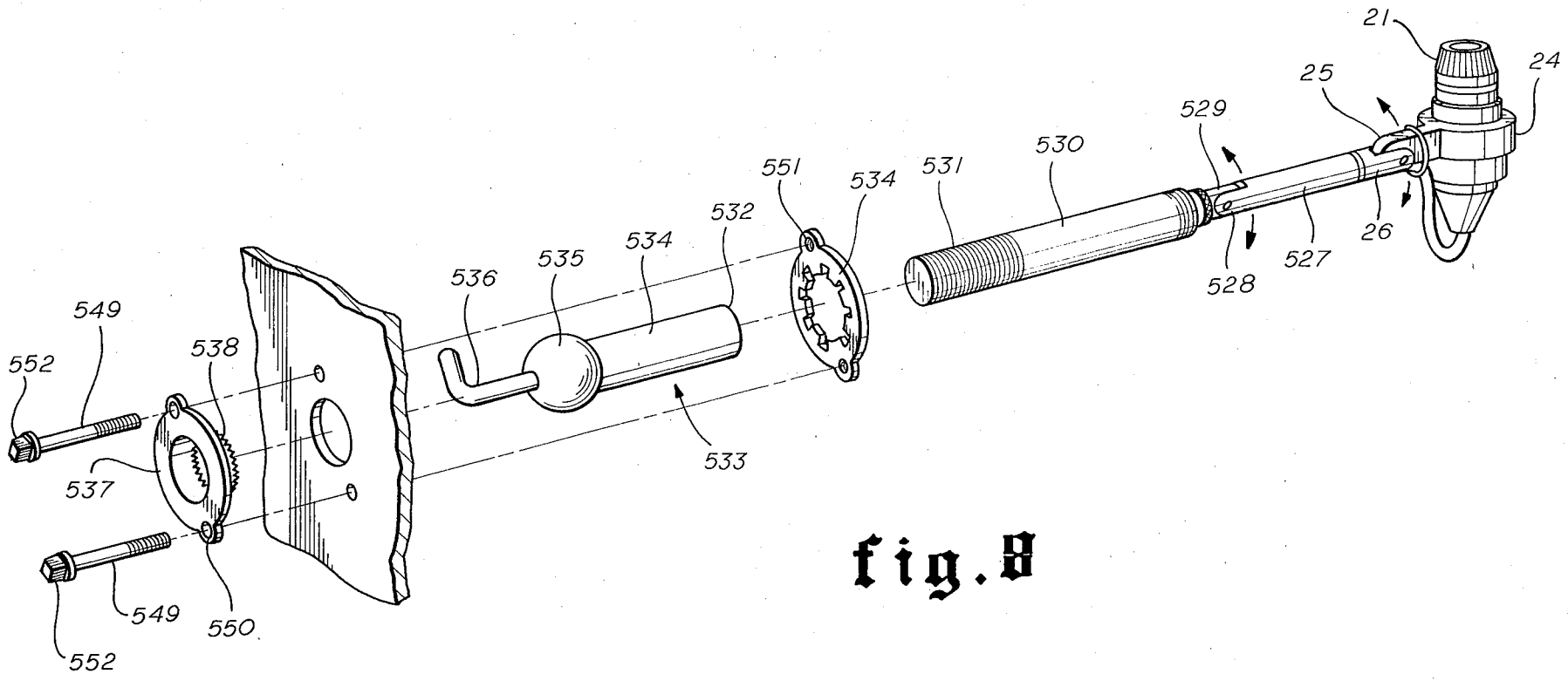
FIG. 8 is an exploded view of another embodiment of the drum assembly providing a universal adjustment of the shock mount and microphone in the drum.

In the embodiment shown in FIG. 8, a slightly different mechanism is shown for supporting the microphone which provides for a universal adjustment. Microphone 21 is supported in shock mount 24 which has its supporting tongue portion 25 supported in clevis 26. Clevis 26 is pivotally supported on support member 527 which has a yoke or clevis portion 528 supported on the end of a pivoted support member 529.

Support member 529 is threadedly secured on a supporting member 530 which has a threaded end portion 531 is secured in the internally threaded end 532 of a universal supporting member 533. Supporting member 533 has a stem portion 534 extending from a molded nylon ball 535 having an adjustment handle 536 extending therefrom. A supporting plate 537 is positioned on the outside of drum shell 13 and has a tubular extension 538 extending through the drum shell.

Nylon ball 535 is supported against the inner, serrated edge of tubular extension 538 with handle 536 protuding through the interior of the supporting plate. A clamping plate 534 is clamped against the rear face of nylon ball 535. Machine screws 549 extend through holes 550 and are tightened into holes 551 in plate 534. Screws 549 have square outer end portions 552 which are arranged for operation by drum key 22.

In this embodiment the adjustment of elliptical position of the microphone 21 is handled manually at the time of installation. Other adjustment is accomplished by loosening screws 549 by means of drum key 22 which allows the entire assembly to be rotated or angularly adjusted by means by handle 536. When the microphone is positioned as desired, screws 549 are tightened to secure the assembly in position.

In the several embodiments of the invention described above, remote adjustment of the microphone is provided in different directions in the drum shell. The remote adjustment features can be combined if desired into a single mechanism providing for rotational, radial, vertical and elliptical adjustment of the positioning of the microphone.

While this invention has been described fully and completely with special emphasis upon several preferred embodiments, it should be understood that within the scope of the appended claims the invention may be practiced otherwise than as specifically described herein.

I claim:

1. An electro-acoustically amplified drum assembly comprising a hollow drum shell having a longitudinally central axis, a drum head closing at least one end of said drum shell an acoustical microphone positioned in said drum shell spaced from and free from any connection to said drum head and adapted to be connected to an external amplifier and speaker, an adjustable mount secured on and extending through the wall of said drum shell and supporting said microphone therein, and mount position adjusting means at least partially operated from outside said drum shell for adjusting the position of said mount radially in said drum shell and rotatably about a radius of said drum shell to position said microphone in a selected position for minimizing microphone interference and optimizing proximity effect and sound quality.

2. An electro-acoustically amplified drum assembly according to claim 1 in which said microphone mount comprises a hollow supporting member in which said microphone is positioned and having an extension pivotally connected to the end of said supporting member, and said mount position adjusting means including a mount supporting member supported for rotary movement about its longitudinal axis and extending radially of said drum shell.

3. An electro-acoustically amplified drum assembly according to claim 1 in which said microphone mount is a shock-resistant and vibration resistant mount, and said mount position adjusting means including a mount supporting member supported for rotary movement about its longitudinal axis and extending radially of said drum shell.

4. An electro-acoustically amplified drum assembly according to claim 1 in which said mount position adjusting means including a first mount supporting member supported for rotary movement about its longitudinal axis and extending radially of said drum shell and further includes means to adjust the position of said microphone longitudinally in relation to the longitudinal central axis of said drum shell.

5. An electro-acoustically amplified drum assembly according to claim 4 in which said mount position adjusting means includes said first supporting member mounted on said drum shell, a second mount supporting member adjustably supported on said first mount supporting member, and means to move said second mount supporting member relative to said first mount supporting member to adjust the position of said microphone longitudinally of said drum shell.

6. An electro-acoustically amplified drum assembly according to claim 5 in which said moving means for said second mount supporting member comprises a rack and pinion mechanism operable to move said microphone laterally of said first supporting member and longitudinally of said drum shell.

7. An electro-acoustically amplified drum assembly according to claim 1 in which said mount position adjusting means includes a drum-mounted supporting member mounted on said drum shell, a mount supporting member supported for movement longitudinally of said drum-mounted supporting member, and means to adjust the position of said mount supporting member longitudinally of said drum-mounted supporting member to move said microphone along said drum-mounted supporting member and radially of said drum shell.

8. An electro-acoustically amplified drum assembly according to claim 7 in which said mount position adjusting means comprises a screw threaded member supported on said drum-mounted supporting member and rotatable to move said mount supporting member longitudinally thereof.

9. An electro-acoustically amplified drum assembly comprising hollow drum shell having a longitudinal central axis, a drum head closing at least one end of said drum shell an acoustical microphone positioned in said drum shell spaced from and free from any connection to said drum head and adapted to be connected to an external amplifier and speaker, an adjustable mount secured on and extending through the wall of said drum shell and supporting said microphone therein, and means at least partially operated from outside said drum shell for adjusting the position of said mount in said drum shell to position said microphone in a selected position for minimizing microphone interference and optimizing proximity effect and sound quality, said microphone mount adjusting means including means to adjust the position of said microphone angularly relative to said central axis in said drum shell and rotatably about a radius of said shell.

10. An electro-acoustically amplified drum assembly according to claim 9 in which said microphone mount adjusting means includes a supporting member mounted on said drum shell, a mount supporting member supported for rotational movement on the end of said supporting member, and means to rotate said mount supporting member on said supporting member to adjust the position of said microphone angularly relative to said central axis in said drum shell.

11. An electro-acoustically amplified drum assembly according to claim 10 in which said mount supporting member rotating means comprises means to rotate said supporting member.

12. An electro-acoustically amplified drum assembly according to claim 10 in which said mount supporting member is supported for pivotal movement in a plane through said supporting member, and said mount supporting member rotating means comprises means to pivot said mount supporting member on said supporting member.

13. An electro-acoustically amplified drum assembly according to claim 12 in which said mount supporting member pivoting means comprises a parallel linkage supporting said mount supporting member, and means to actuate said parallel linkage to pivot said mount supporting member on said supporting member.

14. A mounting bracket for an electro-acoustically amplified drum assembly comprising an adjustable mount including supporting means adapted to be secured on a drum shell, said adjustable mount being adapted to extend through the wall of a drum shell for supporting an acoustical microphone therein spaced from and free from any connection to the drum head and having electric leads adapted to be connected to an external amplifier and speaker, adjusting means supported on said supporting means and operable to vary the position of said mount longitudinally of said supporting means and radially of the drum shell, and means to rotate said supporting means about its longitudinal axis to position said microphone in a selected position for minimizing microphone interference and optimizing proximity effect and sound quality.

15. A mounting bracket according to claim 14 in which said microphone mount comprises a hollow supporting member in which said microphone is positioned and having an extension pivotally connected to the end of said supporting member.

16. A mounting bracket according to claim 14 in which said microphone mount is a shock-resistant and vibration resistant mount.

17. A mounting bracket according to claim 14 in which mount moving means comprises a rack and pinion mechanism operable to move said mount laterally of said supporting member.

18. A mounting bracket according to claim 14 in which said microphone mount adjusting means includes a supporting member adapted to be mounted on said drum shell, a mount supporting member supported for movement longitudinally of said supporting member, and means to adjust the position of said mount supporting member longitudinally of said supporting member to move said microphone radially of said drum shell.

19. A mounting bracket according to claim 18 in which said mount adjusting means comprises a screw threaded member supported on said supporting member and rotatable to move said mount supporting member longitudinally of said supporting member.

20. A mounting bracket according to claim 14 in which said microphone mount adjusting means includes a supporting member adapted to be mounted on said drum shell, a mount supporting member supported for rotational movement on the end of said supporting member, and means to rotate said mount supporting member on said supporting member to adjust the position of said microphone angularly relative to said central axis in said drum shell.

21. A mounting bracket according to claim 20 in which said mount supporting member rotating means comprises a parallel linkage supporting said mount supporting member, and means to actuate said parallel linkage to pivot said mount supporting member on said supporting member.

22. A microphone assembly for an electro-acoustically amplified drum assembly comprising a acoustical microphone, an adjustable mount including supporting means adapted to be secured on a drum shell, said adjustable mount being adapted to extend through the wall of a drum shell for supporting said acoustical microphone therein spaced from and free from any connection to the drum head and having electric leads adapted to be connected to an external amplifier and speaker, adjusting means supported on said supporting means and operable to vary the position of said mount longitudinally of said supporting means and radially of the drum shell, and means to rotate said supporting means about its longitudinal axis to position said microphone in a selected position for minimizing microphone interference and optimizing proximity effect and sound quality.

23. A microphone assembly according to claim 22 in which said microphone mount comprises a hollow supporting member in which said microphone is positioned and having an extension pivotally connected to the end of said supporting member.

24. A microphone assembly according to claim 22 in which said microphone mount is a shock-resistant and vibration resistant mount.

25. A microphone assembly according to claim 22 in which said microphone mount adjusting means includes means to adjust the position of said microphone longitudinally of said drum shell.

26. A microphone assembly according to claim 22 in which said microphone mount adjusting means includes means to adjust the position of said microphone radially, longitudinally or angularly relative to a central axis of said drum shell.

* * * * *